United States Patent [19]

Espenscheid et al.

[11] 4,340,252

[45] Jul. 20, 1982

[54] PROCESS FOR THE IN-SITU LEACHING OF URANIUM

[75] Inventors: Wilton F. Espenscheid, De Soto, Tex.; Tsoung-yuan Yan, Philadelphia, Pa.

[73] Assignee: Mobil Oil Corporation, New York, N.Y.

[21] Appl. No.: 36,627

[22] Filed: May 7, 1979

[51] Int. Cl.[3] ..... E21C 41/14

[52] U.S. Cl. ..... 299/4; 299/5

[58] Field of Search ..... 299/4, 5; 423/15, 17, 423/18, 20

[56] References Cited

U.S. PATENT DOCUMENTS

| | | | |
|---|---|---|---|
| 2,954,218 | 9/1960 | Dew et al. | 299/4 |
| 3,309,141 | 3/1967 | Fitch | 299/4 |
| 3,713,698 | 1/1973 | Rhoades | 299/4 |
| 4,105,253 | 8/1978 | Showalte | 299/5 |

OTHER PUBLICATIONS

Merrit, R. C., *The Extractive Metallurgy of Uranium,* Colo. School of Mines, Research Institute, USA, 1971, pp. 62, 63, 109–111.

*Primary Examiner*—William F. Pate, III

*Attorney, Agent, or Firm*—Charles A. Huggett; James F. Powers, Jr.; John K. AboKhair

[57] ABSTRACT

Process for the in-situ leaching of uranium from a subterranean ore deposit comprising introducing into the deposit an aqueous lixiviant formulated from a dilute sulfuric acid solution which also contains carbon dioxide. The lixiviant has a pH within the range of 1.0–2.5. The lixiviant may also contain an alkali metal sulfate such as sodium sulfate. The process is particularly applicable to subterranean deposits containing uranium associated with carbonaceous material.

6 Claims, 3 Drawing Figures

PROCESS FOR THE IN-SITU LEACHING OF URANIUM

BACKGROUND OF THE INVENTION

The present invention relates to the recovery of uranium from subterranean ore deposits and more particularly to an in-situ leaching operation employing an aqueous solution of sulfuric acid and carbon dioxide as the lixiviant.

In an in-situ leaching operation, a lixiviant is introduced into a subterranean uranium ore deposit through a suitable injection system. The lixiviant may be an acidic or alkaline medium which solubilizes uranium values as it traverses the ore body. The pregnant lixiviant is then withdrawn from the ore body through a production system and treated to recover uranium therefrom by suitable techniques such as solvent extraction, direct precipitation, or by adsorption and elution employing an ion exchange resin.

In acid leaching operations, the most commonly employed acid is sulfuric acid. The sulfuric acid normally is present in the lixiviant in a concentration to provide a pH of 2 or less. Normally, sufficient acid is present in the lixiviant to provide an excess of acid over that consumed by uranium solubilization and inorganic carbonates within the formation in order to retain a relatively low pH in the pregnant lixiviant as it is withdrawn from the ore. For example, as disclosed in Merritt, R. C., THE EXTRACTIVE METALLURGY OF URANIUM, Colorado School of Mines, Research Institute, USA (1971), at pages 62 and 63, under the heading "Acid Concentration", it is desirable to provide excess acid in order to prevent reprecipitation of uranium. Thus, Merritt discloses that free acid concentrations of from 1 to 90 grams per liter (0.1 to 9 weight percent) may be required continuously during the contact period.

The presence of carbonate materials in subterranean rock deposits containing uranium limits the use of acid lixiviants not only with respect to acid consumption by the carbonates but also due to the precipitation of reaction products such as calcium sulfate which may result in plugging of the formation. For example, Merritt at pages 109–111 describes an in-situ leaching procedure employing sulfuric acid which utilizes the natural flow of ground water through the subterranean ore deposit as a containment shell for the leaching solution. Merritt states that when lime bearing materials (carbonates) are present the usual practice is to start feeding the solution at a low concentration of from 1.0 to 1.5 grams of $H_2SO_4$ per liter until acid is detected in the produced effluent. At this time, the lime in the formation is considered to have been neutralized and the acid concentration is increased in increments to a maximum of 5 grams per liter.

The use of sulfuric acid in in-situ leaching of uranium is also disclosed in U.S. Pat. No. 3,309,141 to Fitch et al. In this process, sufficient sulfuric acid is used to react with all the acid consuming materials in the ore body and yet leave a residual solution of not less than 0.005 molar $H_2SO_4$.

In many in-situ leaching operations, particularly where the subterranean ore body has a high carbonate content, carbonate lixiviants are employed. These lixiviants contain carbonate or bicarbonate ions or mixtures thereof which function to complex the uranium in the form of water-soluble uranyl carbonate ions. The carbonate lixiviants may be formulated by the addition of alkali metal or ammonium carbonates and/or bicarbonates or by the addition of carbon dioxide together, in most cases, with an alkaline agent, e.g. sodium hydroxide or ammonia, to control the pH. An in-situ leaching procedure in which the lixiviant contains carbonate and bicarbonate ions is disclosed in U.S. Pat. No. 4,105,253 to Showalter. In this process, the injected lixiviant is a neutral or near-neutral solution of carbonic acid formulated by dissolving carbon dioxide in the injected water. The pH of the injected lixiviant is maintained within the range of 6 to 7 to provide a bicarbonate ion concentration between about 380 ppm and 1,000 ppm.

U.S. patent application Ser. No. 934,933 filed Aug. 18, 1978 by Edward Thomas Habib, Jr. discloses an in-situ leaching process which involves the injection of a near-neutral or alkaline lixiviant in which an alkali metal sulfate such as sodium sulfate is employed as a leaching agent. The pH of the lixiviant may range down to about 6 and the lixiviant may also contain minor amounts of alkali metal carbonates or bicarbonates.

SUMMARY OF THE INVENTION

In accordance with the present invention, there is provided a new and improved process for the recovery of uranium from a subterranean deposit by employing a dilute sulfuric acid solution which also contains carbon dioxide. In carrying out the invention, there is introduced into the uranium-containing deposit via a suitable injection system an aqueous lixiviant containing an oxidizing agent, sulfuric acid, and carbon dioxide and which has a pH within the range of 1.0–2.5. As the lixiviant traverses the subterranean uranium deposit, uranium therein is solubilized in the lixiviant. The resulting pregnant lixiviant containing uranium is then produced from the deposit via a suitable production system and then treated to recover uranium therefrom. Preferably, the sulfuric acid concentration in the lixiviant is within the range of 0.1–1.0 weight percent. In a further embodiment of the invention, the injected lixiviant also contains an alkali metal sulfate.

DESCRIPTION OF THE SPECIFIC EMBODIMENTS

Some subterranean ore deposits which are refractory to near-neutral or alkaline lixiviants employing carbonate and/or bicarbonate ions as the leaching agent are more readily leached with an acid lixiviant employing sulfuric acid. However, in many cases, such deposits contain significant quantities of carbonate materials such as calcite which, as noted in the aforementioned material by Merritt, may lead to excessive acid consumption as well as plugging by precipitation of calcium sulfate. The present invention results from the discovery that uranium may be leached from the subterranean formation employing a dilute solution of sulfuric acid which also contains carbon dioxide. The carbon dioxide in combination with sulfuric acid functions to increase the leaching rate and also the ultimate uranium recovery without excessive consumption of sulfuric acid. The lixiviant also contains in addition to the sulfuric acid and carbon dioxide a suitable oxidizing agent such as air, oxygen, hydrogen peroxide, or sodium chlorate. As will be understood by those skilled in the art, the oxidizing agent functions to oxidize the uranium from the insoluble tetravalent state to the soluble hexavalent state where it is complexed by the lixiviant.

In experimental work relative to the invention, leaching tests were carried out on samples of a composite ore obtained from different depths of the same core hole penetrating a subterranean uranium deposit. The ore contained uranium in the form of coffinite occurring as individual grains and aggregates of grains in a matrix of carbonaceous material. The matrix contains other minerals such as pyrite, apatite, anatase or rutile, and chlorite. The carbonaceous material occurs in a poorly sorted sandstone consisting of detrital quartz, feldspar and rock fragments. Locally abundant kaolinite or chlorite, calcite and the carbonaceous material are the primary cementing agents. The ore contained uranium in a concentration of 0.091 weight percent calculated as $U_3O_8$ and contained 0.12 weight percent of carbonaceous material calculated as organic carbon. The carbonate concentration of the ore was 1.93 weight percent calculated as calcium carbonate.

In the experimental work, high pressure column leaching tests were carried out. In this procedure, the uranium ore was packed into a vertical column having an internal diameter of $\frac{7}{8}$" and a length of 30". The lixiviant was flowed upwardly through the column and recovered from the other end and then analyzed for its uranium content. In each case the lixiviant was pumped through the column at a flow rate of 0.5 pore volume per day.

Figure 1:
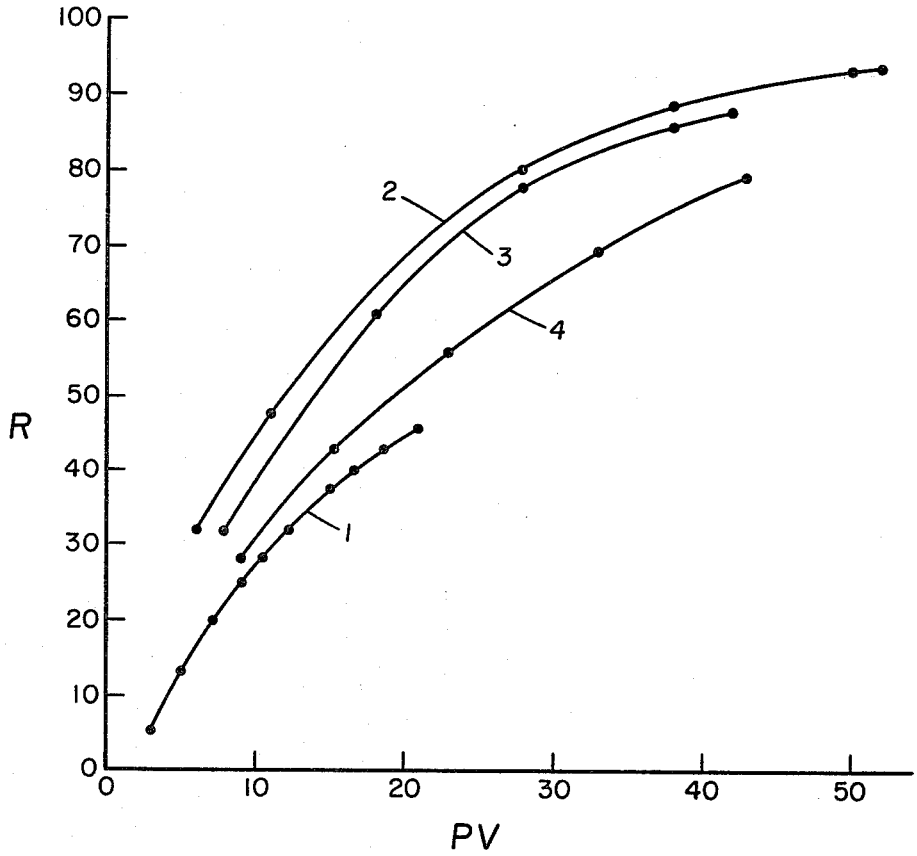
FIG. 1 is a graph illustrating the effect of carbon dioxide and sulfuric acid on uranium recovery as a function of the pore volumes of lixiviant.

In a first column leaching test, the lixiviant was formulated by the addition of 5 grams per liter of sulfuric acid, 74 grams per liter of sodium sulfate, and 1 gram per liter of sodium chloride to distilled water. Elemental oxygen was employed as the oxidizing agent and was dissolved in the lixiviant under a pressure of 800 psig. The results of this test are shown in FIG. 1 by curve 1 which is a plot of the percentage of uranium recovery, R, plotted on the ordinate versus the cumulative pore volumes, PV, of leaching solution injected plotted on the abscissa. As can be seen from an examination of curve 1, the percent uranium recovery had reached a value of about 46 percent when the test was terminated after the injection of 21 pore volumes of lixiviant.

In a second column leaching test, the lixiviant contained a lower amount of sulfuric acid (4 grams per liter) but in this case the lixiviant contained carbon dioxide under a partial pressure of 15 psi. The lixiviant was saturated with a slightly smaller amount of oxygen under a partial pressure of 785 psi. It contained the same concentration of sodium chloride (1 gram per liter) and sodium sulfate in a concentration of 15 grams per liter. The decreased sodium sulfate concentration is not considered to be of significance for comparative purposes since previous experimental work indicates that additional sodium sulfate in an amount above 5 to 10 grams per liter has little or no additional effect on uranium recovery. The results of this test are shown by curve 2 of FIG. 1. As illustrated, the addition of carbon dioxide resulted in a significantly higher leaching rate as indicated by the slope of the curve and also a significantly higher ultimate uranium recovery. At 21 pore volumes, the uranium recovery was about 70 percent and at 52 pore volumes, when the test was terminated, the uranium recovery was about 94 percent.

A third column test employing carbon dioxide was carried out with the same acid concentration (5 grams per liter) as in the first test but with a significantly lower concentration of oxidizing agent. In this case, the oxygen was dissolved in the lixiviant under a pressure of 385 psig. The carbon dioxide pressure was again 15 psig and the lixiviant also contained 15 grams per liter of sodium sulfate and 1 gram per liter of sodium chloride. The results of this leaching test are illustrated in FIG. 1 by curve 3. This test resulted in a uranium recovery only slightly lower than that obtained with the second test and again well above the recovery observed for the acid leaching run carried out without carbon dioxide. In a fourth test, the oxygen, carbon dioxide, sodium sulfate, and sodium chloride concentrations in the lixiviant were identical to those employed in the third test but the sulfuric acid concentration was reduced sharply to a value of 2 grams per liter. As shown by curve 4, this test still showed a significant improvement in uranium recovery over that attained without the use of carbon dioxide notwithstanding the much lower acid concentration and oxygen pressure.

Figure 2:
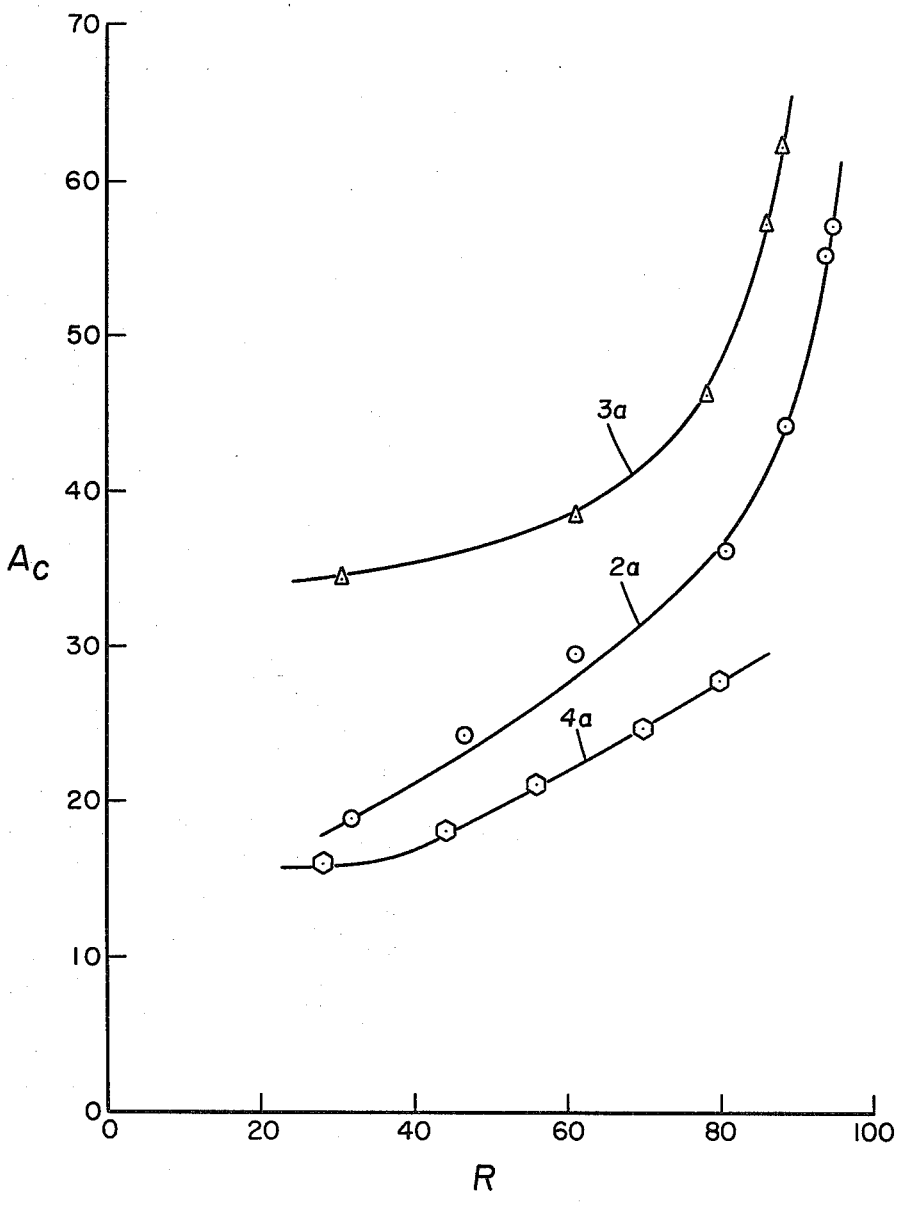
FIGS. 2 and 3 are graphs illustrating the consumption rate of sulfuric acid as a function of sulfuric acid concentration and percent uranium recovery.
Figure 3:
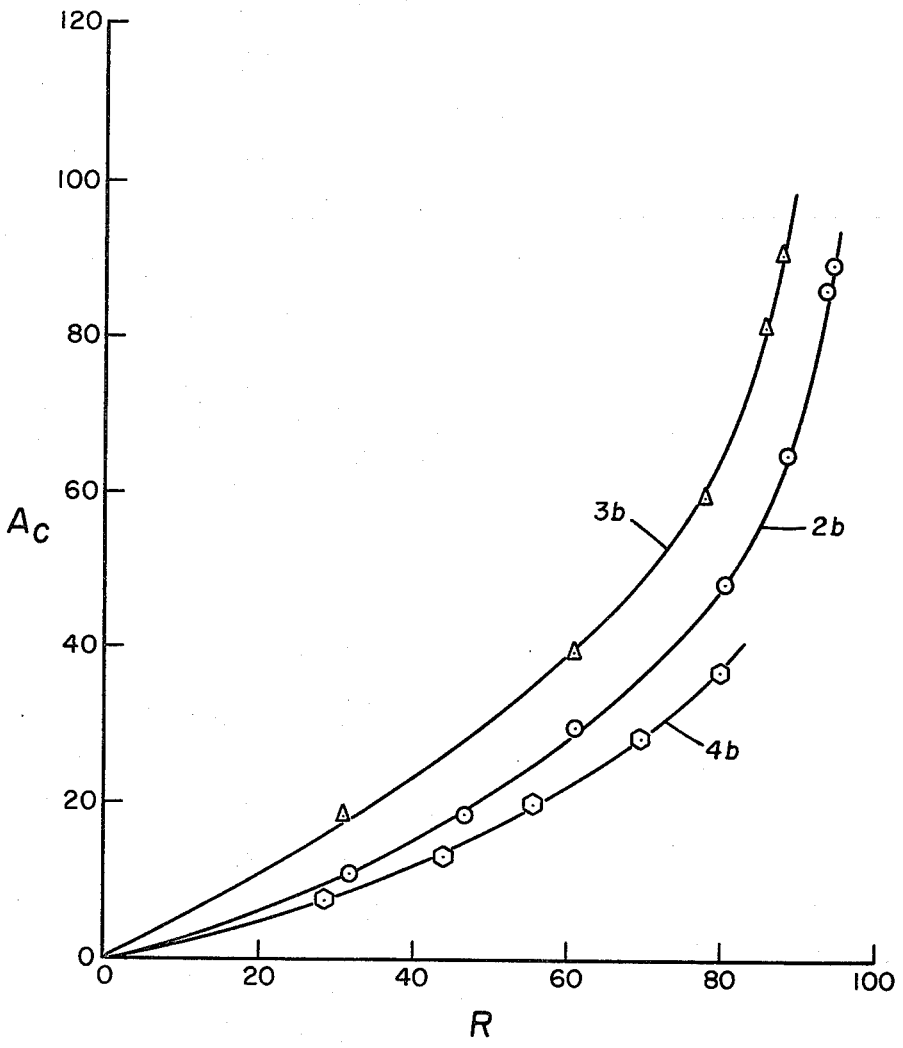

The acid consumption levels associated with sulfuric acid-carbon dioxide leaching system are illustrated in FIGS. 2 and 3. In FIG. 2, the acid consumption, $A_c$, in pounds of sulfuric acid per pound of $U_3O_8$ is plotted on the ordinate versus the percent uranium recovery plotted on the abscissa. In FIG. 3, the acid consumption is plotted on the ordinate in terms of pounds of sulfuric acid per ton of uranium ore. The acid consumption rates for the second, third, and fourth tests are indicated in FIG. 2 by curves 2*a*, 3*a*, and 4*a*, respectively, and in FIG. 3 by curves 2*b*, 3*b*, and 4*b*, respectively. As shown by FIGS. 2 and 3, the acid consumption increases with the acid concentration of the lixiviant. Thus, the acid concentration should be held down to the lowest value consistent with an acceptable leaching rate. While the pH of the lixiviant may be as low as one (corresponding to a sulfuric acid concentration of near 2 percent), it will be preferred to limit the acid concentration to a value no greater than 1 weight percent and more desirably no greater than 0.5 weight percent. Preferably, the acid will be present in a concentration of at least 0.1 weight percent, corresponding to a pH of about 2. However, as noted previously, somewhat lower acid levels may be employed but the pH of the injected lixiviant should not be allowed to exceed 2.5.

Many refractory ores, such as the ore employed in the above-described experimental work, contain uranium associated with carbonaceous material. The carbonaceous material is present in intimate contact with the uranium mineral and retards access to the uranium by the lixiviant. A preferred application of the present invention is in leaching such deposits which contain the uranium associated with the carbonaceous material. While applicants' invention is not to be limited by theory, it is believed that the sulfuric acid functions to disrupt the carbonaceous material so that the uranium is exposed to the solubilizing action of the lixiviant. In most cases, the carbonaceous material will be present in the uranium deposit in an amount of at least 0.1 weight percent expressed as total organic carbon. The concentration may range up to about 2 weight percent expressed as total organic carbon.

The carbon dioxide in the lixiviant may be added in any suitable amount but normally will be present in a concentration of at least 0.05 weight percent, corresponding to a carbon dioxide partial pressure of about 6 psi. Preferably, the carbon dioxide concentration is at least 0.1 weight percent corresponding to a carbon dioxide partial pressure of about 11 psi. At the pH level of the injected lixiviant, the carbon dioxide forms carbonic acid which is only slightly dissociated and equilibrated with the carbonate and bicarbonate ions. While a significant bicarbonate ion concentration is usually regarded as desirable and even necessary in the solubilization of uranyl carbonate complexes, it would appear that the use of carbon dioxide in the present invention results in carbonate complexing of the uranium. While this mechanism cannot be readily explained, it is noted that a pH transition zone exists within the formation at least during the early stages of the leaching process. In this regard, the pregnant lixiviant recovered in the above-described column tests remained relatively high, within the range of about 6.5 to 7.5, until most of the uranium was recovered. At about 60 percent uranium recovery in the case of the second and third tests and about 70 percent in the case of the fourth test, the pH then declined sharply reaching a value of less than 3 in the second and third tests and slightly more than 4 in the fourth test at the maximum uranium recovery. The maximum $CO_2$ pressure is dictated by the formation pressure and also the oxygen partial pressure where oxygen is used as the oxidizing agent. In most cases, however, the carbon dioxide partial pressure will not exceed 300 psi, equivalent to a carbon dioxide concentration in the lixiviant of 2.7 weight percent.

As noted previously, the lixiviant may also contain an alkali metal sulfate which functions as a complexing agent. Usually sodium sulfate will be used for reasons of economy and ready availability. The sulfate may be used in any suitable amount but the optimum effect on uranium recovery occurs with a sulfate concentration of about 0.5–1.0 weight percent (5–10 grams per liter). Amounts greater than 1 percent normally have little or no additional effect upon uranium recovery and thus it will normally be desirable to employ the alkali metal sulfate in a concentration of up to about 1.0 percent and preferably within the range of 0.5–1.0 percent.

The present invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

As noted previously, elemental oxygen normally will be used as the oxidizing agent although other strong oxidants such as hydrogen peroxide and sodium chlorate may also be used. Typically, the oxygen pressure of the lixiviant may range from about 25 to 2000 psia, with a preferred range of 100 to 1,000 psia.

We claim:

1. In the recovery of uranium from a subterranean uranium-containing deposit penetrated by injection and production systems, the method comprising:

(a) introducing into said deposit via said injection system an aqueous lixiviant containing an oxidizing agent, sulfuric acid, and carbon dioxide and having a pH within the range of 1.0–2.5, (b) displacing said lixiviant through said subterranean deposit to solubilize uranium therein, (c) producing pregnant lixiviant containing uranium from said production system, and (d) treating said pregnant lixiviant to recover uranium therefrom.

2. The method of claim 1 wherein said lixiviant also contains an alkali metal sulfate.

3. The method of claim 1 wherein the concentration of sulfuric acid in said lixiviant is within the range of 0.1–1.0 weight percent.

4. The method of claim 1 wherein said carbon dioxide is present in a concentration of at least 0.05 weight percent.

5. The method of claim 1 wherein said subterranean deposit contains uranium associated with carbonaceous material.

6. The method of claim 1 wherein said carbon dioxide is present in said lixiviant in a concentration of at least 0.1 weight percent.

* * * * *